US011530082B2

(12) United States Patent
Maschio

(10) Patent No.: US 11,530,082 B2
(45) Date of Patent: Dec. 20, 2022

(54) PLATE FOR METAL CAGE FOR TANK

(71) Applicant: MASCHIO N.S. S.R.L., Grezzago (IT)

(72) Inventor: Pietro Maschio, Pozzo d'Adda (IT)

(73) Assignee: MASCHIO N.S. S.R.L., Grezzago (IT)

( * ) Notice: Subject to any disclaimer, the term of this patent is extended or adjusted under 35 U.S.C. 154(b) by 233 days.

(21) Appl. No.: 16/881,202

(22) Filed: May 22, 2020

(65) Prior Publication Data

US 2020/0369448 A1 Nov. 26, 2020

(30) Foreign Application Priority Data

May 23, 2019 (IT) ..... 102019000007147

(51) Int. Cl.
*B65D 77/04* (2006.01)

(52) U.S. Cl.
CPC ..... *B65D 77/0466* (2013.01)

(58) Field of Classification Search
CPC ..... B65D 33/00; B65D 19/0006; B65D 19/0002; B65D 19/00; B65D 77/044; B65D 77/0433; B65D 77/0426; B65D 77/042; B65D 77/0413; B65D 77/0406; B65D 77/04; B65D 77/0466; B65D 25/205

See application file for complete search history.

(56) References Cited

U.S. PATENT DOCUMENTS

| | | | | |
|---|---|---|---|---|
| 1,672,171 | A | 6/1928 | Reis | |
| 5,450,681 | A | 9/1995 | Stolzman | |
| 5,787,623 | A | 8/1998 | Schutz | |
| 2013/0193031 | A1* | 8/2013 | Butruille | B65D 19/36 206/597 |

(Continued)

FOREIGN PATENT DOCUMENTS

| | | |
|---|---|---|
| DE | 93 09 086.2 U1 | 8/1993 |
| DE | 20 2016 004 745 U1 | 10/2016 |

OTHER PUBLICATIONS

Italian Search Report dated Feb. 10, 2020 in Italian Application 102019000007147 filed May 23, 2019 (with English Translation of Categories of Cited Documents and Written Opinion), 10 pages.

*Primary Examiner* — Kareen K Thomas
(74) *Attorney, Agent, or Firm* — Oblon, McClelland, Maier & Neustadt, L.L.P.

(57) ABSTRACT

Plate (10) for a metal cage (110) for a tank (130) containing a liquid, wherein said metal cage (110) comprises a base frame (120) on which a base of said tank (130) rests and a plurality of horizontal bars (111) and vertical bars (112), associated with each other and forming a grid, which contains said tank (130), said plate (10) being separably mounted with at least two bars (111, 112) of said plurality of horizontal (111) and vertical bars (112), characterised in that said plate (10) comprises a vertical wall (14) and at least two through openings (15) hollowed in said vertical wall (14), at least two C-shaped engagement elements (20), each C-shaped engagement element comprises a first portion (23) adapted to pass through a through opening (15) of said at least two through openings (15) and adapted to enclose at least a first portion (113) of a bar (111, 112) of said plurality of said bars (111, 112) and a second portion (24) adapted to enclose at least one end portion (11, 12) of said plate (10) and at least a second portion (114) of a bar (111, 112) of said plurality of said bars (111, 112).

11 Claims, 4 Drawing Sheets

(56) References Cited

U.S. PATENT DOCUMENTS

| | | | | |
|---|---|---|---|---|
| 2014/0028037 | A1* | 1/2014 | Ness | B65D 88/54 294/68.1 |
| 2016/0001951 | A1* | 1/2016 | Siebel | B65D 85/70 206/386 |
| 2016/0001961 | A1* | 1/2016 | Trinko | B65D 75/004 221/48 |
| 2018/0237199 | A1* | 8/2018 | Weyrauch | A62C 3/065 |
| 2018/0346220 | A1* | 12/2018 | Weyrauch | B65D 19/385 |
| 2019/0062024 | A1* | 2/2019 | Maschio | B23K 31/02 |
| 2019/0225400 | A1* | 7/2019 | Weyrauch | B65D 19/02 |
| 2019/0382177 | A1* | 12/2019 | Paul | B65D 19/385 |
| 2019/0382178 | A1* | 12/2019 | Weyrauch | B65D 77/068 |

* cited by examiner

PLATE FOR METAL CAGE FOR TANK

The present invention relates to a plate for a metal cage for a tank.

In the state of the art, metal cages for tanks for transporting and storing liquids are known. The metal cage is used to protect the tank and to limit deformations in the shape of the tank itself. The tanks in fact have a parallelepiped shape which on the one hand allows a rapid stacking of the same, but on the other it does not allow to distribute the strains in a balanced way on the surface of the tank. The metal cage is therefore necessary to strengthen the shape of the tank and limit its deformation. Plates are placed on the tanks to indicate the generality of the liquid contained or the danger of the same. The plates are affixed to the cage by means of screws.

Disadvantageously, cycles for filling and emptying the tank with liquids and transporting the tank tend to deform the shape of the tank. The metal cage containing the tank opposes the deformation of the shape of the tank by opposing a tension force to the strains generated by the liquid that presses over the walls of the tank. It follows that the grid formed by a plurality of bars of the metal cage deforms and the screws with which the plates are affixed to the bars unscrew making the plate fall and making the recognition of the liquid contained in the caged tank difficult, making any operations for example by specialised workers or fire fighters difficult.

The object of the present invention consists in the fact of realising a plate for metal cages for tanks capable of remaining firmly and securely affixed to the metal cage also following transport and/or external stresses, for example due to other metal cages stacked together or internal ones, due to the liquid contained in the tank which deforms the structure of the metal cage.

According to the invention, this object is achieved with a plate for a metal cage for a tank according to claim 1.

Another object of the present invention consists in the fact of realising a metal cage for a tank comprising a plate capable of remaining firmly and securely affixed to the metal cage also following transport and/or external stresses, for example, due to other metal cages stacked together or internal ones, due to the liquid contained in the tank which deforms the structure of the metal cage.

According to the invention, said other object is achieved with a metal cage for a tank comprising a plate according to claim 9.

Other features are envisaged in the dependent claims.

The features and advantages of the present invention will be more apparent from the following description, which is to be understood as exemplifying and not limiting, with reference to the appended schematic drawings, wherein:

FIG. 1 is a perspective view of a metal cage for a tank containing liquid where the metal cage contains the tank and the metal cage consists of a base frame and a plurality of horizontal and vertical bars associated with each other and forming a grid with a parallelepiped shape containing the tank, where the metal cage comprises a plate mounted by means of C-shaped engagement elements according to the present invention;

Figure 1:
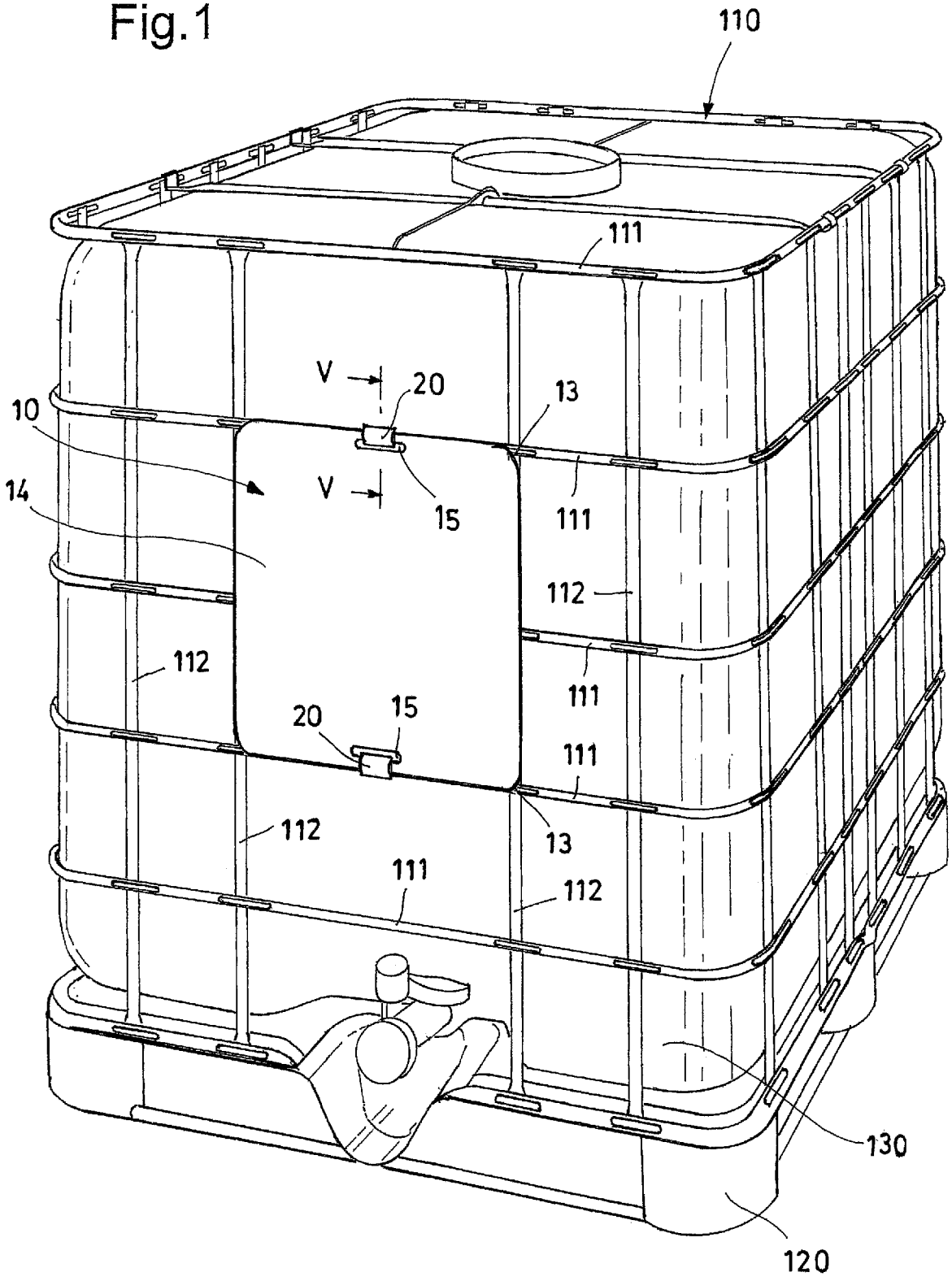

With reference to the cited figures, a plate 10 for a metal cage 110 for a tank 130 containing a liquid is shown, where said metal cage 110 comprises a base frame 120 on which a base of said tank 130 rests and a plurality of horizontal bars 111 and vertical bars 112 associated with each other and forming a grid which contains said tank 130.

The metal cage 110 has a parallelepiped shape and said tank 130 has a parallelepiped shape.

Said plate 10 is separably mounted with at least two bars 111, 112 of said plurality of horizontal 111 and vertical bars 112.

In particular, FIG. 1 shows a plate 10 mounted with two horizontal bars 111 of the metal cage 110.

Figure 2:
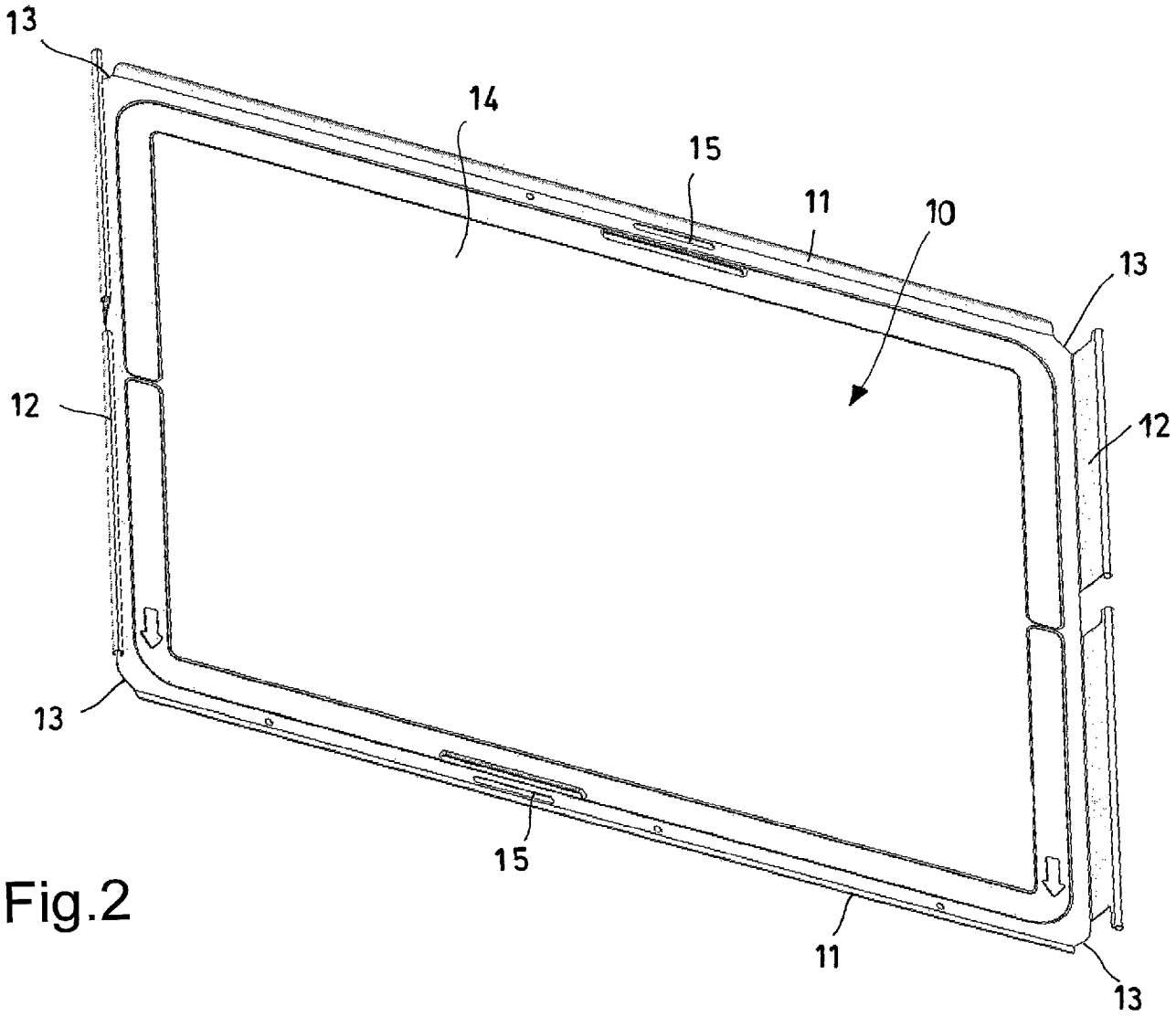
FIG. 2 is an axonometric perspective front view of the plate according to the present invention.

As shown in particular in FIGS. 1 and 2, the plate 10 comprises a vertical wall 14 and at least two through openings 15 hollowed in said vertical wall 14.

Said plate 10 comprises at least two C-shaped engagement elements 20. As shown in particular in FIGS. 1, 3-6, each C-shaped engagement element comprises a first portion 23 adapted to pass through a through opening 15 of said at least two through openings 15 and adapted to enclose at least a first portion 113 of a bar 111, 112 of said plurality of said bars 111, 112 and a second portion 24 adapted to enclose at least one end portion 11, 12 of said plate 10 and at least a second portion 114 of a bar 111, 112 of said plurality of said bars 111, 112.

Said vertical wall 14 has a rectangular shape and said two through openings 15 are hollowed near the geometrical sides of said vertical wall 14.

In particular, as shown in FIGS. 1 and 2 it is possible to provide for said two through openings 15 to be arranged on opposite sides of said vertical wall 14, i.e. that the two through openings 15 are hollowed in the vertical wall 14 with opposite geometrical sides of the vertical wall 14 near the bars 111, 112 of the metal cage 110.

Alternatively, it is possible to provide for the vertical wall 14 of the plate 10 to comprise four through openings 15, one for each side of the vertical wall 14.

Said two through openings 15 have a rectangular shape so that each of them can be easily engaged by said C-shaped engagement element 20.

Said plate 10 is made of metal and is resistant to fire to allow fire fighters to read the indications present on the plate 10 in case of fire.

Said vertical wall 14 comprises at least two opposite sides, each of which protrudes into said end portion 11, 12. Each end portion 11, 12 of said vertical wall 14 comprises a curvilinear-shaped cross section which is adapted to engage over a portion of a bar 111, 112 of said plurality of bars 111, 112, where said portion of a bar 111, 112 comprises at least a curvilinear-shaped cross section as shown in particular in FIGS. 2 and 5.

In particular FIG. 2 shows that the plate 10 comprises four curvilinear ends 11, 12, one for each side of the vertical wall 14, an upper end 11, a lower end 11 and two lateral ends 12, left and right.

Figure 3:
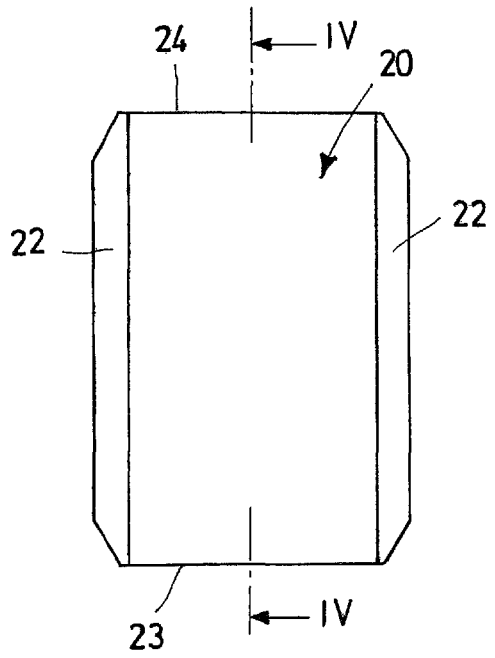
FIG. 3 is a view of a C-shaped engagement element.
Figure 4:
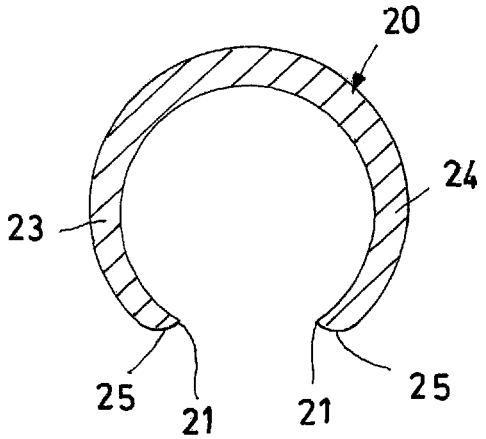
FIG. 4 is a section view according to the line IV-IV of FIG. 3.

As shown in particular in FIGS. 3 and 4, said C-shaped engagement element 20 comprises two ends 21 of the respective first 23 and second portion 24, each end 21 of said two ends 21 comprise a pointed cross section which advantageously allows to be inserted into the through opening 15 with greater ease.

Each of said two ends 21 of said C-shaped engagement element 20 comprises a rounded portion 25 to facilitate the engagement within the through opening 15.

Said C-shaped engagement element 20 comprises two bevelled lateral sides 22 which allow to strengthen a stiffness of the C-shaped engagement element 20.

The C-shaped engagement element 20 is made of plastic and is sufficiently elastic to be inserted inside the slot 15 and to engage snap-fittingly the end portion 11, 12 of the vertical wall 14 and the bar 111, 112 on which it is engaged to hold the plate 10 on the metal cage 110.

Figure 5:
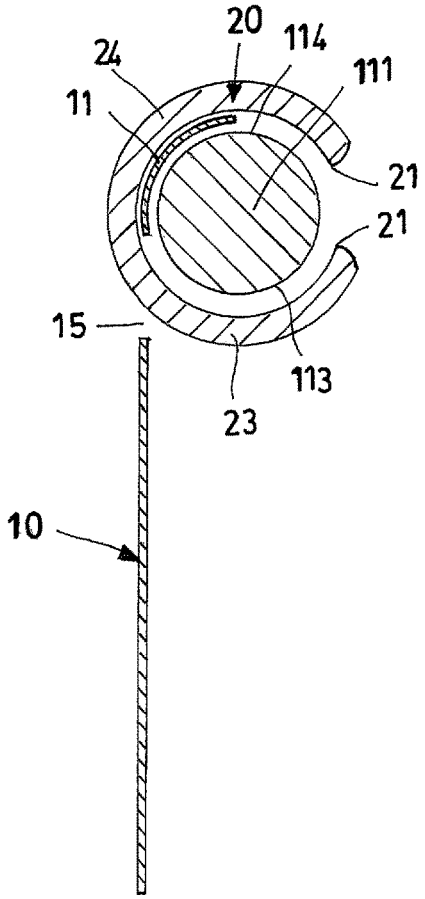
FIG. 5 is a section view according to the line V-V of FIG. 1.

The bars 111, 112 of the metal cage 110 comprise a circular-shaped cross section as shown in particular in FIG. 5.

Figure 6:
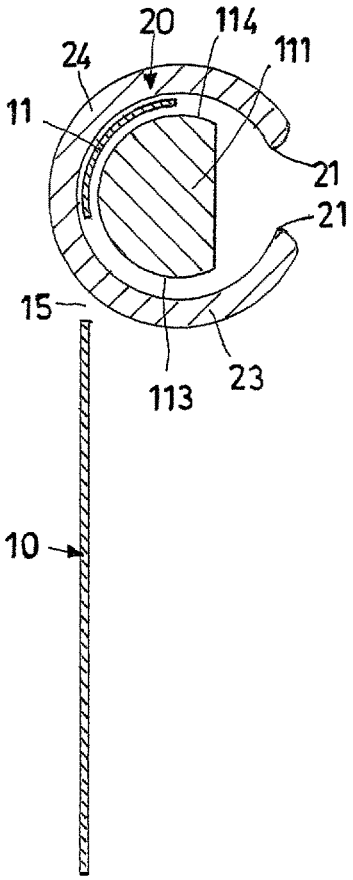
FIG. 6 shows a section view according to the line V-V of FIG. 1 of a cage with D-shaped tubular bars with alternative cross section.

Alternatively, the bars 111, 112 are provided to comprise a D-shaped cross section as shown in FIG. 6.

The invention thus conceived is susceptible to many modifications and variants, all falling within the same inventive concept; furthermore, all details can be replaced by equivalent technical elements. In practice, the materials used, as well as the dimensions thereof, can be of any type according to the technical requirements.

The invention claimed is:

1. A plate for a metal cage for a tank containing a liquid, wherein said metal cage comprises:

a base frame, on which a base of said tank rests, and a plurality of horizontal bars and vertical bars, associated with each other and forming a grid, which contains said tank, wherein said plate is separably mounted with at least two bars of said plurality of horizontal and vertical bars, wherein said plate comprises:

a vertical wall having at least two through openings hollowed in said vertical wall, and at least two C-shaped engagement elements of C, and wherein each C-shaped engagement element comprises:

a first portion adapted to pass through a through opening of said at least two through openings and adapted to enclose at least a first portion of a bar of said plurality of horizontal and vertical bars, and a second portion adapted to enclose at least one end portion of said plate and at least a second portion of a bar of said plurality of horizontal and vertical bars.

2. A plate according to claim 1, wherein said vertical wall has a rectangular shape, and wherein said two through openings are hollowed near the geometrical sides of said vertical wall.

3. A plate according to claim 1, wherein said two through openings are arranged on opposite sides of said vertical wall.

4. A plate according to claim 1, wherein said two through openings have a rectangular shape.

5. A plate according to claim 1, wherein said plate is metallic.

6. A plate according to claim 1, wherein said vertical wall comprises at least two opposite sides, each of which protrudes into said at least one end portion, wherein each at least one end portion of said vertical wall comprises a curvilinear-shaped cross section, which is adapted to engage over a portion of a bar of said plurality of horizontal and vertical bars, and wherein said portion of a bar of said plurality of horizontal and vertical bars comprises at least a curvilinear-shaped cross section.

7. A plate according to claim 1, wherein said C-shaped engagement element further comprises two ends of the respective first and second portions, and wherein each end of said two ends comprises a pointed cross section.

8. A plate according to claim 7, wherein each end of said two ends of said C-shaped engagement element further comprises a rounded portion.

9. A plate according to claim 1, wherein said C-shaped engagement element further comprises two beveled lateral sides.

10. A metal cage for a tank containing a liquid, wherein said metal cage comprises:

a base frame on which a base of said tank and a plurality of horizontal and vertical bars rest and are associated with each other, forming a grid which contains said tank, and a plate according to claim 1, wherein said plate is separably mounted with at least two bars of said plurality of horizontal and vertical bars.

11. A metal cage according to claim 10, wherein said grid has a parallelepiped shape, and wherein said tank has a parallelepiped shape.

* * * * *